US011359824B2

(12) United States Patent
Kadu et al.

(10) Patent No.: US 11,359,824 B2
(45) Date of Patent: Jun. 14, 2022

(54) SLIDABLE ELECTRIC CONTROL BOX FOR ROOFTOP UNIT

(71) Applicant: Johnson Controls Technology Company, Auburn Hills, MI (US)

(72) Inventors: Bhushan C. Kadu, Pune (IN); Manjur A. Tamboli, Norman, OK (US); Siddappa R. Bidari, Pune (IN); Bhushan D. Vichare, Sangli (IN)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 155 days.

(21) Appl. No.: 16/780,255

(22) Filed: Feb. 3, 2020

(65) Prior Publication Data

US 2021/0239331 A1 Aug. 5, 2021

(51) Int. Cl.
*F24F 1/22* (2011.01)

(52) U.S. Cl.
CPC ..... *F24F 1/22* (2013.01)

(58) Field of Classification Search
CPC ..... F24F 1/06; F24F 1/20; F24F 1/22
USPC ..... 62/259.1
See application file for complete search history.

(56) References Cited

U.S. PATENT DOCUMENTS

2014/0117825 A1* 5/2014 Lee ..... H05K 5/00 312/309

FOREIGN PATENT DOCUMENTS

| | | |
|---|---|---|
| CN | 205987608 | 2/2017 |
| CN | 107906720 | 4/2018 |
| CN | 108674130 | 10/2018 |
| CN | 208025645 | 10/2018 |

* cited by examiner

*Primary Examiner* — Steve S Tanenbaum
(74) *Attorney, Agent, or Firm* — Fletcher Yoder, P.C.

(57) ABSTRACT

A heating, ventilation, and/or air conditioning (HVAC) system includes a cabinet in which HVAC components of the HVAC system are disposed, a mount disposed in the cabinet and having a first guide disposed thereon, and an electric control box. The electric control box includes a second guide disposed thereon, where the first guide and the second guide are configured to engage with each other to enable the electric control box to slide relative to the mount between an operational position within the cabinet and a maintenance position outside of the cabinet.

20 Claims, 8 Drawing Sheets

SLIDABLE ELECTRIC CONTROL BOX FOR ROOFTOP UNIT

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. An HVAC system may control the environmental properties through control of an air flow delivered to the environment. In certain HVAC systems, a rooftop unit may be employed and include a condenser section, an evaporator section, and controls configured to control aspects of the condenser section and the evaporator section to control an air flow and/or a refrigerant used to exchange heat with an air flow. The rooftop unit may include electric control components configured to control and/or power certain devices of the rooftop unit.

In traditional rooftop units, the electric control components may be cumbersome and/or installed in the rooftop unit in a manner that is difficult to access for purposes such as maintenance and repair. Accordingly, improved rooftop units, and installation of electric control components thereof, are desired.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates to a heating, ventilation, and/or air conditioning (HVAC) system. The HVAC system includes a cabinet in which HVAC components of the HVAC system are disposed, a mount disposed in or on the cabinet and having a first guide disposed thereon, and an electric control box. The electric control box includes a second guide disposed thereon, where the first guide and the second guide are configured to engage with each other to enable the electric control box to slide relative to the mount between an operational position within the cabinet and a maintenance position outside of the cabinet.

The present disclosure also relates to a heating, ventilation, and/or air conditioning (HVAC) system. The HVAC system includes a cabinet in which a fan and a compressor of the HVAC system are disposed, a mounting structure disposed in the cabinet and between the fan and the compressor, and having a first guide rail extending therefrom, and an electric control box disposed between the fan and the compressor. The electric control box includes a second guide rail engaged with the first guide rail and configured to slide along the first guide rail between an operational position in which the electric control box is disposed inside of the cabinet and a maintenance position in which the electric control box is disposed outside of the cabinet.

The present disclosure also relates to a heating, ventilation, and/or air conditioning (HVAC) system. The HVAC system includes a cabinet in which a fan and a compressor of the HVAC system are disposed, a mount of the cabinet disposed between the fan and the compressor, and having a first guide rail extending therefrom, and an electric control box disposed between the fan and the compressor. The electric control box includes a second guide rail engaged with the first guide rail and configured to slide along the first guide rail between an operational position in which the electric control box is disposed inside of the cabinet and a maintenance position in which the electric control box is disposed outside of the cabinet. The electric control box also includes a housing that encloses electric components of the electric control box, a wire harness extending from the electric components, and an opening in the housing through which the wire harness extends.

DETAILED DESCRIPTION

Figure 1:
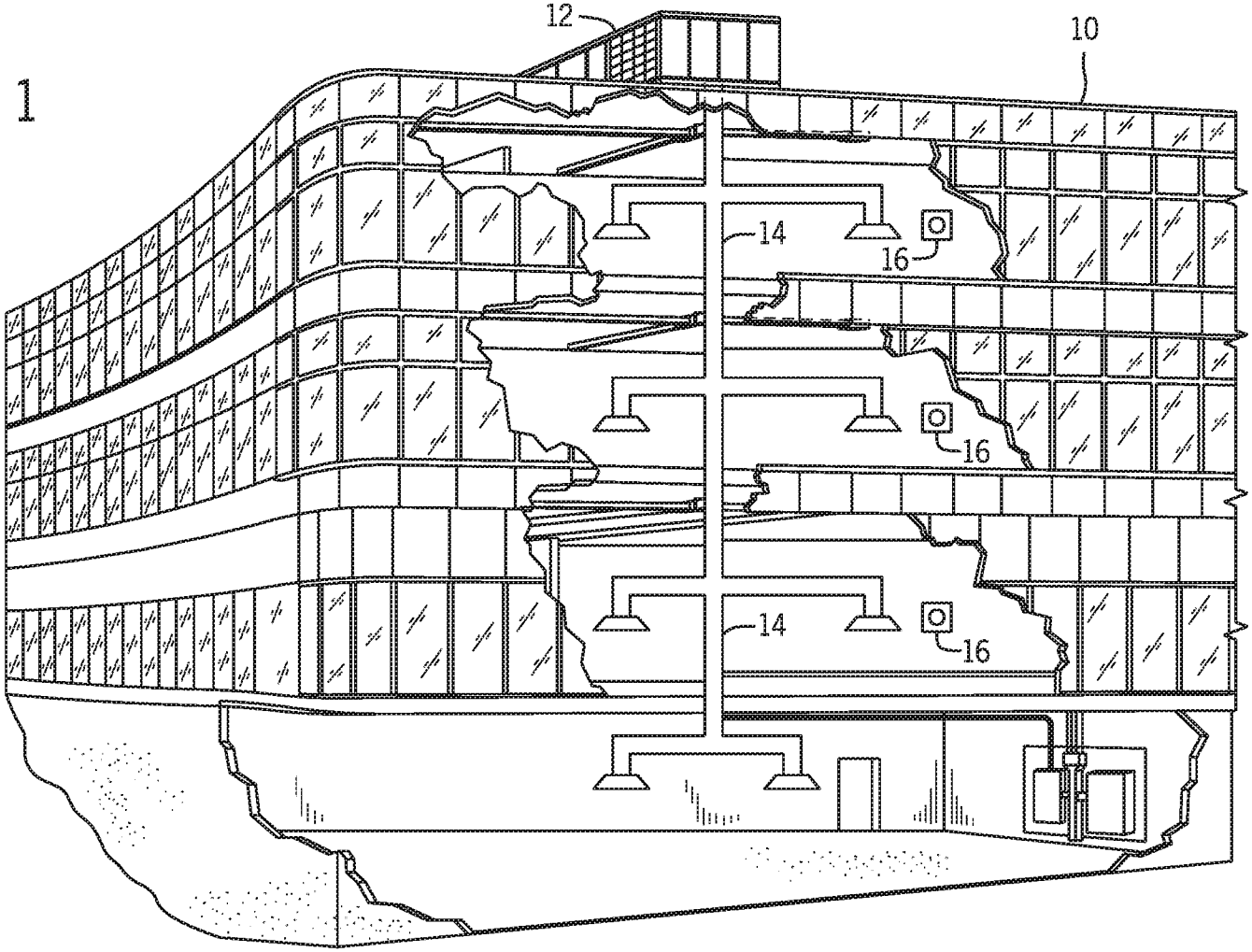
FIG. 1 is a perspective view of an embodiment of a building that may utilize a heating; ventilation, and/or air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design; fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure is directed toward a heating, ventilation, and/or air conditioning (HVAC) system that includes a rooftop unit having an electric control box. In particular, the present disclosure is directed toward a slidable electric control box configured to engage a mounting structure of the rooftop unit, such as a mounting structure incorporated with a cabinet of the rooftop unit.

Rooftop units may include electric control components configured to control and/or power certain devices, such as air flow and/or refrigerant flow devices, of the rooftop unit. In traditional rooftop units, electric control components may be cumbersome and/or installed in the rooftop unit in a manner that is difficult to access for purposes such as maintenance and repair. In accordance with the present disclosure, the electric control components are included in an electric control box that slidably engages a mounting structure of the rooftop unit, such as a mounting structure of a cabinet of the rooftop unit. For example, the slidable electric control box may include a guide rail (e.g., an extension or flange) that engages a corresponding guide rail (e.g., an extension or flange) of the mounting structure. For example, the slidable electric control box may include a hook or U-shaped cross-section that receives a flange of the mounting structure. Additionally or alternatively, wheels may be disposed between the slidable electric control box and an engagement surface of the mounting structure. Additionally or alternatively, the mounting structure may include a slot (e.g., open-ended slot) through which a guide rail (e.g., an extension or flange) of the slidable electric control box extends and through which the extension is configured to slide. In any of the preceding embodiments, the slidable electric control box may include an opening through a housing of the slidable electric control box, through which a wire harness is configured to extend. The wire harness may include slack that, together with the above-described opening in the housing of the slidable electric control box, enables a connection of the wire harness to another feature, such as a power or data source, even during and after the slidable electric control box has been moved from an operational position to a maintenance and repair position.

By incorporating the electric control components in the slidable electric control box described above and below, installation, maintenance, and repair of the rooftop unit may be simplified. These and other features will be described in detail below with reference to the drawings.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include; but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential; commercial; industrial, transportation, or other applications where climate control is desired.

In the illustrated embodiment, a building 10 is air conditioned by a system that includes an HVAC unit 12, which may include a cabinet and components disposed within the cabinet. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
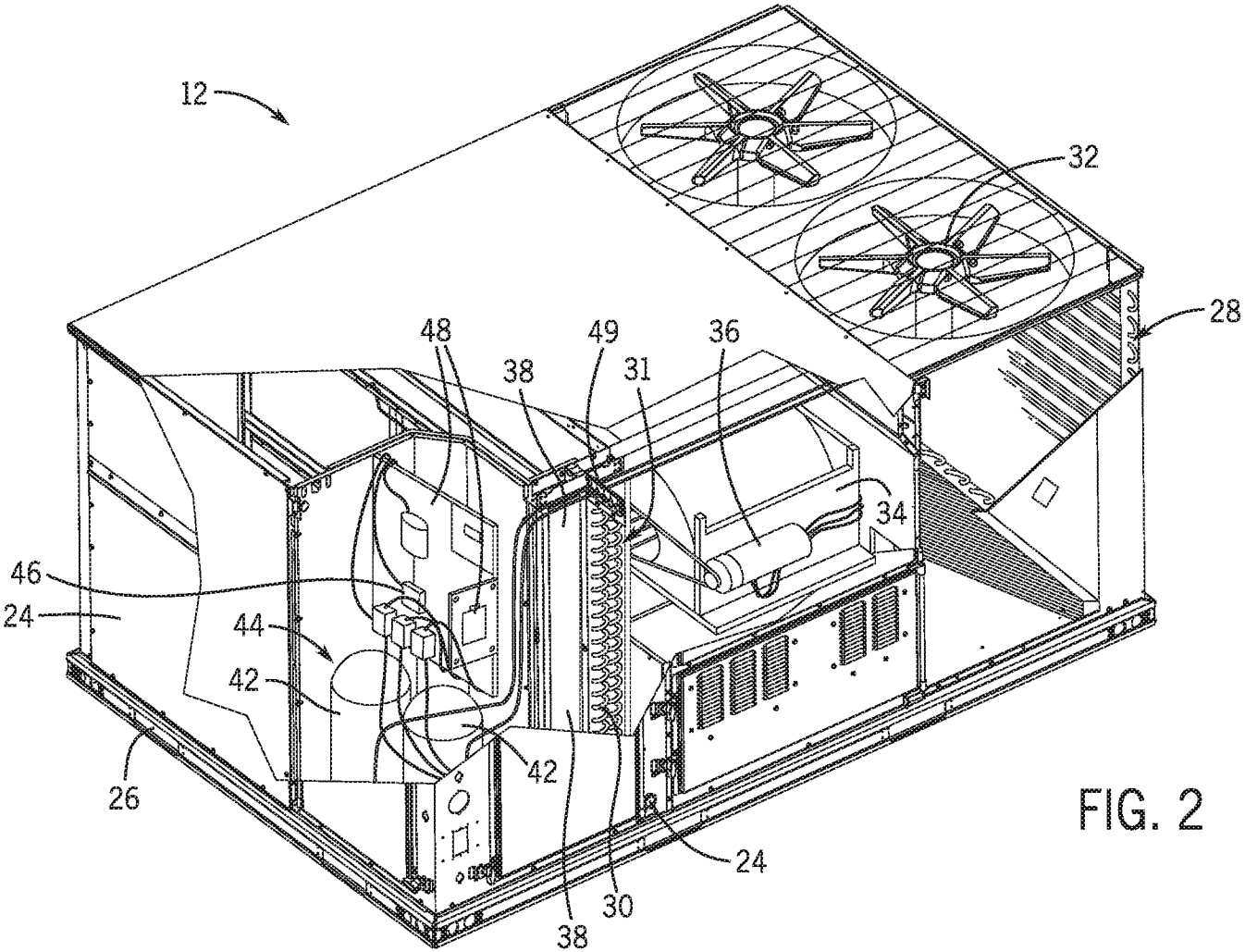
FIG. 2 is a perspective view of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Further, in certain embodiments, the cabinet 24 or a portion thereof may include frame members or beams forming a frame structure that contains HVAC components therein. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately, or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
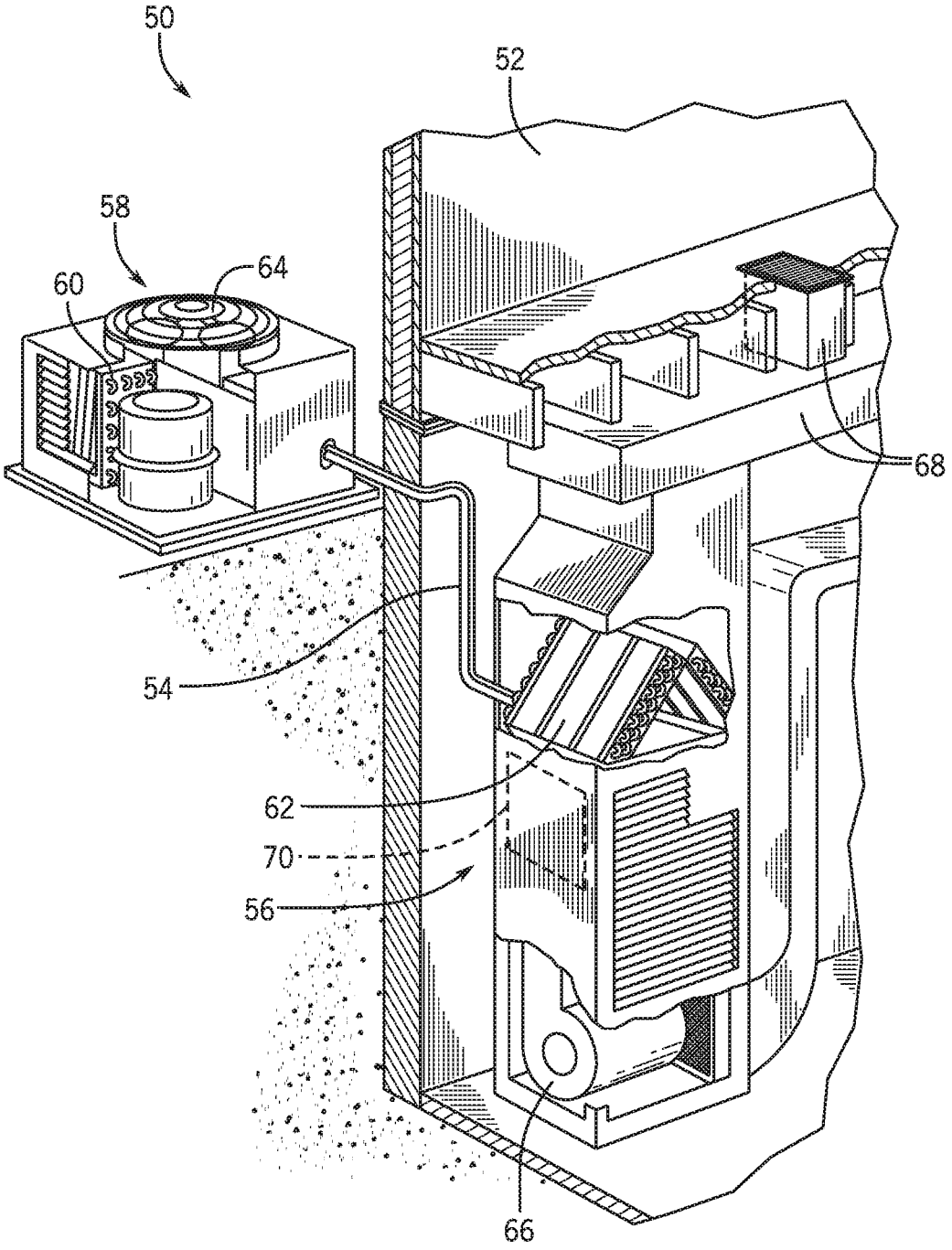
FIG. 3 is a perspective view of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit 56 functions as an evaporator. Specifically, the heat exchanger 62 receives liquid refrigerant, which may be expanded by an expansion device, and evaporates the refrigerant before returning it to the outdoor unit 58.

The above-described shroud of outdoor unit 58 may include a mesh structure, or other air intake, that forms an air flow path between an interior and exterior of the shroud. The outdoor unit 58 draws environmental air into the shroud, via the air intake, and through the heat exchanger 60 using a fan 64, and expels the air above the outdoor unit 58. The fan 64 may be protected by a fan guard similar to, or different than, the above-described air intake of the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
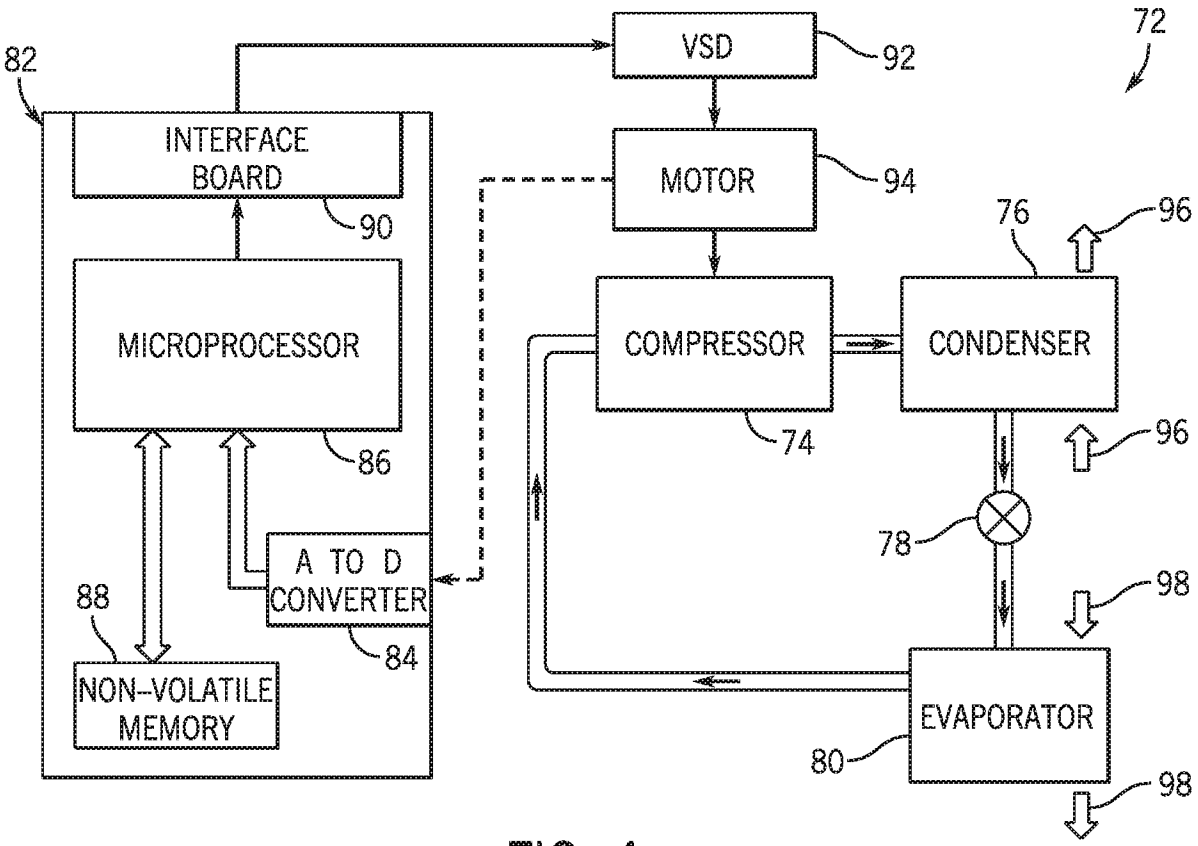
FIG. 4 is a schematic diagram of a vapor compression system that may be used in an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Figure 5:
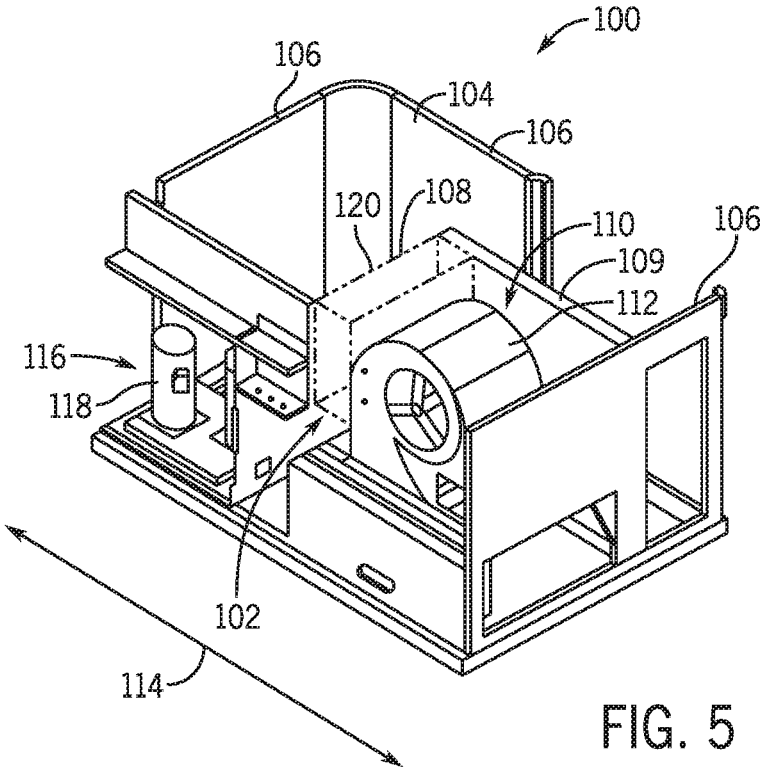
FIG. 5 is a perspective view of a rooftop unit having an electronics cavity configured to receive a slidable electric control box; in accordance with an aspect of the present disclosure.

In each of FIGS. 1-4, the disclosed HVAC systems may represent a rooftop unit having a slidable electric control box. For example, the rooftop unit may include a mounting structure, which may be a part of a cabinet of the rooftop unit. The slidable electric control box may include a guide rail (e.g., an extension or flange) that engages a corresponding guide rail (e.g., an extension or flange) of the mounting structure. For example, the slidable electric control box may include a hook or U-shaped cross-section that receives a flange of the mounting structure. Additionally or alternatively, wheels may be disposed between the slidable electric control box and an engagement surface of the mounting structure. Additionally or alternatively, the mounting structure may include a slot (e.g., open-ended slot) through which a guide rail (e.g., an extension or flange) of the slidable electric control box extends and through which the extension is configured to slide. In any of the preceding embodiments, the slidable electric control box may include an opening through a housing of the slidable electric control box, through which a wire harness is configured to extend. The wire harness may include slack that, together with the above-described opening in the housing of the slidable electric control box, enables a connection of the wire harness to another feature, such as a power or data source, even during and after the slidable electric control box has been moved from an operational position to a maintenance and repair position By incorporating the slidable electric control box in a rooftop unit of any of the HVAC systems described above and illustrated in FIGS. 1-4, installation, maintenance, and repair of the rooftop unit may be simplified. With the foregoing in mind, FIG. 5 is a perspective view of an embodiment of a rooftop unit 100 having a control box cavity 102 configured to receive a slidable electric control box. The slidable electric control box is not shown in the illustrated embodiment. The control box cavity 102 in the illustrated embodiment is defined within a cabinet 104 of the rooftop unit 100. For example, the cabinet 104 may include outer walls 106 that define an outer perimeter of the rooftop unit 100, where air flow and/or refrigerant flow components of the rooftop unit 100 are disposed within the cabinet 104. For purposes of showing the control box cavity 102, a front wall of the rooftop unit 100 is not shown. The cabinet 104 may also include interior walls 108, 109 configured to partition various cavities within the cabinet 104. In the illustrated embodiment, two interior walls 108, 109 at least partially define a fan compartment 110 in which a fan 112 (e.g., centrifugal fan) is disposed. The control box cavity 102 is also disposed in the fan compartment 100, between the interior wall 108 and the fan 112 along a length dimension 114 of the rooftop unit 100.

The illustrated inclusion of the control box cavity 102 within the fan compartment 110 and between the interior wall 108 and the fan 112 may improve packaging of the rooftop unit 100 relative to traditional embodiments. For example, the illustrated arrangement may reduce a volume of the rooftop unit 100 relative to traditional embodiments. However, in another embodiment in accordance with the present disclosure, the control box cavity 102 may be disposed in a different area of the cabinet 104, such as a compressor compartment 116 containing one or more compressors 118, a condenser compartment, an evaporator compartment, or a different compartment.

Figure 6:
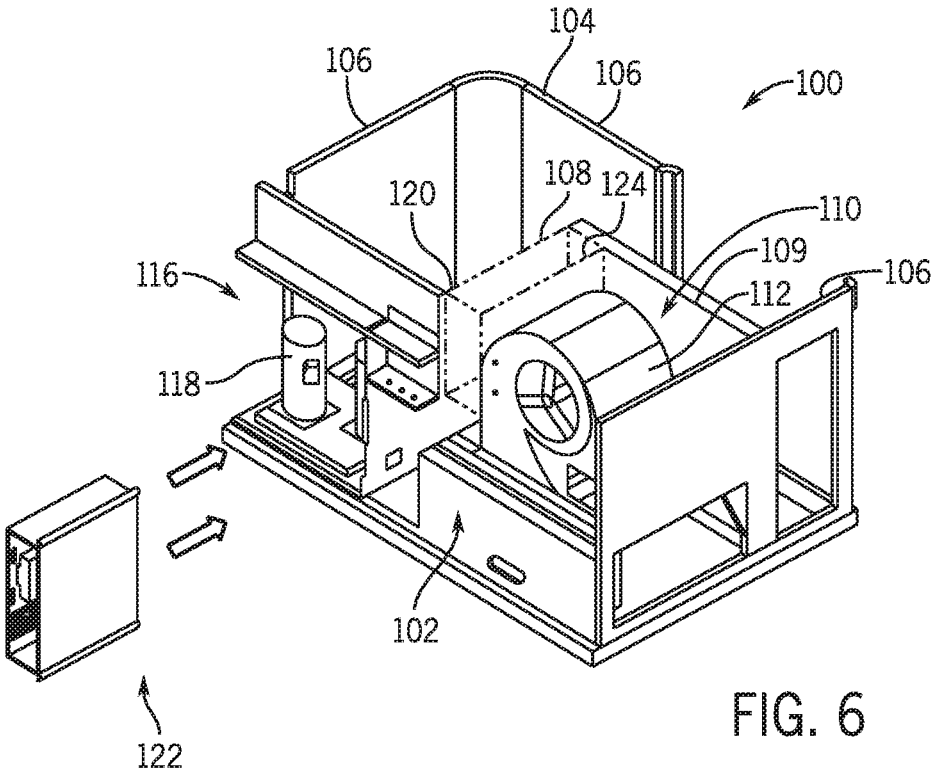
FIG. 6 is an exploded perspective view of the rooftop unit of FIG. 5 and the slidable electric control box, in accordance with an aspect of the present disclosure.
Figure 7:
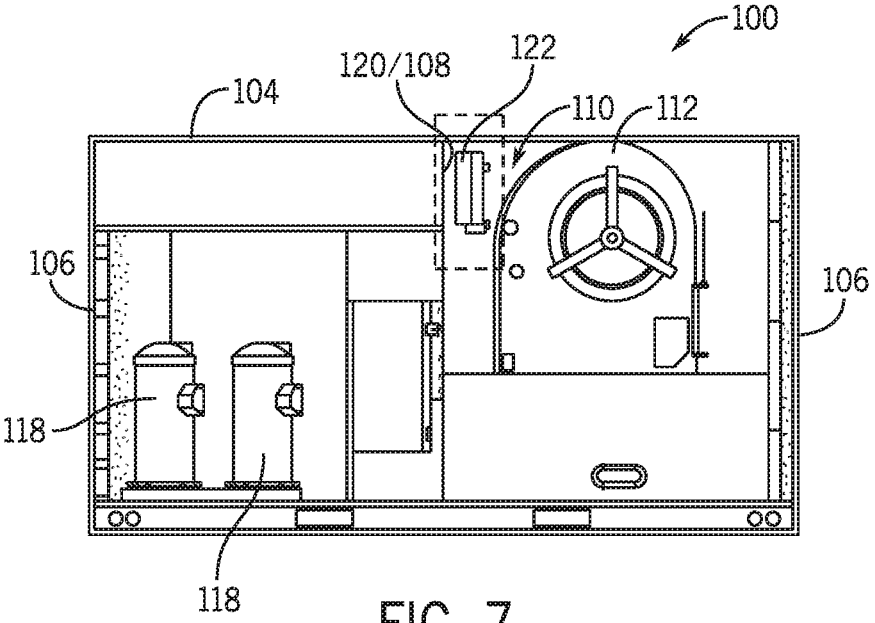
FIG. 7 is a side view of the rooftop unit of FIG. 5 with the slidable electric control box disposed in the electronics cavity, in accordance with an aspect of the present disclosure.

In the illustrated embodiment, the interior wall 108 may act as a mounting structure 120 for mounting a slidable electric control box (not shown) into and out of the control box cavity 102. For example, the mounting structure 120 may include certain features, such as flanges, hooks, slots, wheels, or other features, that enable sliding of the slidable electric control box (not shown) into and out of the control box cavity 102 for purposes of installing the electric control box, maintaining the electric control box, repairing the electric control box, or other reasons. FIG. 6 is an exploded perspective view of an embodiment of the rooftop unit 100 of FIG. 5 and a slidable electric control box 122. Further, FIG. 7 is a side view of an embodiment of the rooftop unit 100 of FIG. 5 with the slidable electric control 122 box disposed in the electronics cavity. As in FIG. 5, a front wall of the cabinet 104 of the rooftop unit 100 is removed in FIGS. 6 and 7 for purposes of illustrating the control box cavity 102. As shown, the slidable electric control box 112 may be disposed in the control box cavity 102 between the interior wall 108 and the fan 112. In some embodiments, such as the embodiment illustrated in FIG. 6, an additional interior wall 124 may be disposed between the fan 112 and the control box cavity 102. While the interior wall 108 may act as the mounting structure 120 for mounting the slidable electric control box 122 in the control box cavity 102, the additional interior wall 124 of FIG. 6 may additionally or alternatively act as the mounting structure. The mounting structure may also include a top wall (not shown) of the cabinet 104, or a different panel or wall. Further, it should be noted that the mounting structure 120 may be considered a part of the cabinet 104, or may be a separate part from the cabinet 104. Further still, the mounting structure 120 may include a single surface extending in a plane, or may include multiple surfaces. Mounting features between the slidable electric control box 122 and the mounting structures (e.g., mounting structure 120) will be described in detail below with reference to later drawings.

Figure 8:
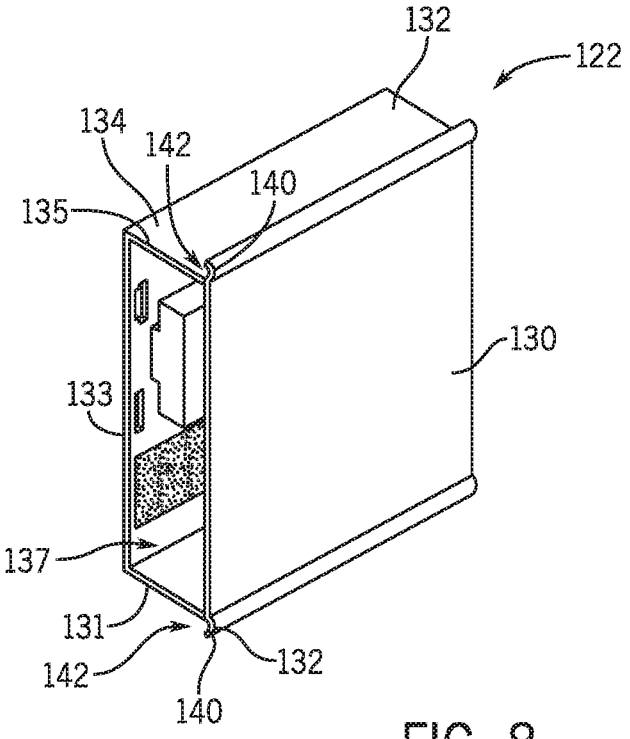
FIG. 8 is a cross-sectional perspective view of a slidable electric control box for the rooftop unit of FIG. 5; in accordance with an aspect of the present disclosure.

FIG. 8 is a cross-sectional perspective view of an embodiment of a slidable electric control box 112 for the rooftop unit 100 of FIG. 5. The slidable electric control box 112 includes a cover plate 130 and guide rails 132 extending from, or adjacent to, the cover plate 130. The guide rails 132 may be configured to engage a feature, such as a flange, of a mounting structure. Further, the guide rails 132 may be configured to slide along the flange to enable the slidable electric control box 112 to slide into and out of a control box cavity. The slidable electric control box 112 in the illustrated embodiment also includes a control box housing 134 attached to the cover plate 130. Electric components 136 of the slidable electric control box 112 may be disposed between the control box housing 134 and the cover plate 130. For example, the control box housing 134 and the cover plate 130 may partially or fully enclose the electric components 136 in a cavity 137 defined between the control box housing 134 and the cover plate 130. In the illustrated embodiment, the control box housing 134 includes a U-shaped cross-section formed by a first wall 131, a second wall 133, and a third wall 135, where the cover plate 130 is disposed opposite to the second wall 133 and between the first wall 131 and the third wall 133. The electric components 136 may be disposed primarily or entirely on the second wall 133. For example, the second wall 133 may act as, include, or be formed by a printed circuit board (PCB) having all or some of the electric components 136 disposed thereon.

In some embodiments, the guide rails 132 may extend from the control box housing 134 (e.g., the guide rails 132 may be integrally formed with the control box housing 134), and the cover plate 130 may be coupled to the control box housing 134 adjacent to the guide rails 132. In other embodiments, the guide rails 132 may extend from the cover plate 130 (e.g., the guide rails 132 may be integrally formed with the cover plate 130), and the control box housing 134 may couple to the cover plate 130 adjacent to the guide rails 132. In still other embodiments, the guide rails 132 may be separate from the cover plate 130 and the housing 134, and the guide rails 132, the cover plate 130, and the control box housing 134 may be coupled together. In any of the embodiments described above, the guide rails 132 may be configured to engage extensions from, or flanges of, the aforementioned mounting structure (e.g., the mounting structure 120 in FIG. 7). For example, in the illustrated embodiment, the guide rails 132 each include a U-shaped or curvilinear cross-section 140 defining a space 142 to receive the extensions from, or flanges of, the aforementioned mounting structure (e.g., the mounting structure 120 of FIG. 7). The extensions from, or flanges of, the mounting structure may enable the guide rails 132 to slide across the extensions or flanges between a maintenance position and an operational position. Additional or alternative engagement features between the slidable electric control box 122 and the mounting structure are described in detail below.

FIGS. 9-12 are cross-sectional side views of embodiments of the slidable electric control box 122 interfaced with the mounting structure 120 of the rooftop unit 100 of FIG. 5. In each of the embodiments illustrated in FIGS. 9-12, the slidable electric control box 122 includes at least one guide rail 132 that engages at least one corresponding guide rail 150 of the mounting structure 120. For example, in FIG. 9, the slidable electric control box 122 includes the housing 134. The housing 134 includes the guide rails 132, where the guide rails 132 include an L-shaped cross-section. The guide rails 150 of the mounting structure 120, which extend from a panel 152, also include an L-shaped cross-section. Although two guide rails 132 of the slidable electric control box 122 and two guide rails 150 of the mounting structure 120 are shown in the illustrated embodiment, another embodiment may include only one of the two guide rails 132 and only one of the two guide rails 150. Although not shown in the illustrated embodiments, a stopper may be disposed on any of the guide rails 132 and/or 150, where the stopper is configured to block the slidable electric control box 122 from total disengagement with the mounting structure 120. For example, the slidable electric control box 122 may be configured to slide between an operational position and a maintenance position, and the stopper may be configured to retain engagement between the slidable electric control box 122 and the mounting structure 120 while the slidable electric control box 122 is in the maintenance position. The stopper may include, for example, a flange or extension that contacts a feature of the mounting structure 120 (e.g., a portion of the guide rail 150) while the slidable electric control box 122 is in the maintenance position.

Figure 9:
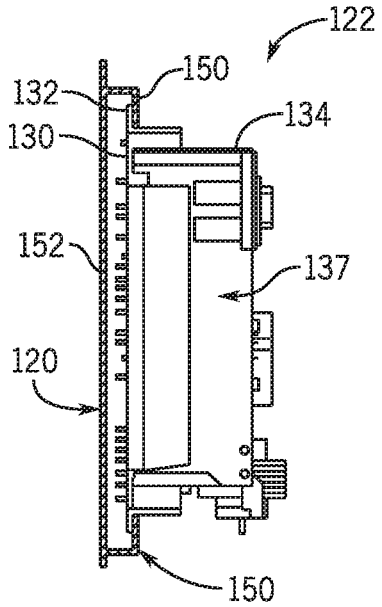
FIG. 9 is a cross-sectional side view of a slidable electric control box interfaced with a mounting structure of the rooftop unit of FIG. 5, in accordance with an aspect of the present disclosure.
Figure 10:
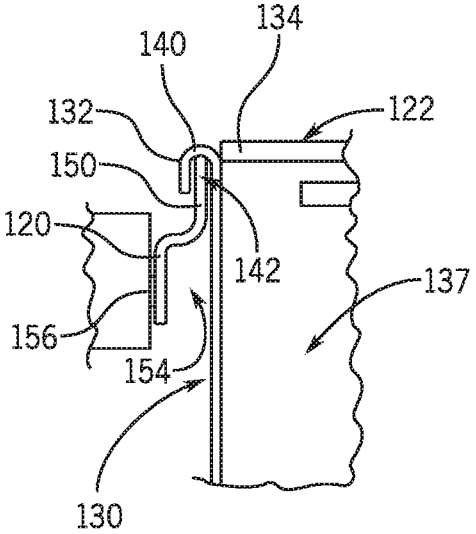
FIG. 10 is a cross-sectional side view of a portion of a slidable electric control box interfaced with a portion of a mounting structure of the rooftop unit of FIG. 5, in accordance with an aspect of the present disclosure.

In FIG. 10, the mounting structure 120 does not include the panel 152 in FIG. 9, but instead includes a bracket 154 having the guide rail 150. The bracket 154 may be bolted via a bolt 156 to another portion of the rooftop unit 100 of FIG. 5, such as a cabinet feature (e.g., a wall or panel). In the illustrated embodiment, the guide rail 132 of the slidable electric control box 122 extends from the cover plate 130 of the slidable electric control box 122, and includes the U-shaped cross-section 140 and the space 142 defined by the U-shaped cross-section 140 previously described with respect to FIG. 8. In FIG. 10, the U-shaped cross-section 140 of the guide rail 132 of the slidable electric control box 122 receives the guide rail 150 of the bracket 154 of the mounting structure 120. Although only one guide rail 150 of the mounting structure 120 and only one guide rail 132 of the slidable electric control box 122 are included in FIG. 10, another embodiment may include opposing guide rails 150 and opposing guide rails 132.

Figure 11:
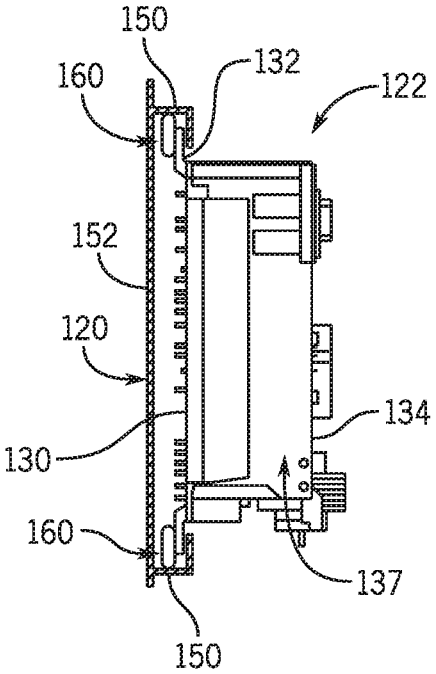
FIG. 11 is a schematic cross-sectional side view of a slidable electric control box interfaced with a mounting structure of the rooftop unit of FIG. 5, in accordance with an aspect of the present disclosure.

In FIG. 11, the mounting structure 120 includes the panel 152 previously described with respect to FIG. 9, and the guide rails 150 extending therefrom and including L-shaped cross-sections. The guide rails 132 of the slidable electric control box 122 engage the guide rails 150 of the mounting structure 120 via intervening wheels 160. That is, wheels 160 may contact the guide rails 150 of the mounting structure 120, and the wheels 160 may enable smooth movement of the slidable electric control box 122 along the guide rails 150. In another embodiment, the wheels 160 may be incorporated or coupled to the mounting structure 120, and the guide rails 132 of the slidable electric control box 122 may slide along the wheels 160. As previously suggested, in some embodiments, the wheel(s) 160 may be disposed along only one of the guide rails 132 of the slidable electric control box 122 or only one of the guide rails 150 of the mounting structure 120.

Figure 12:
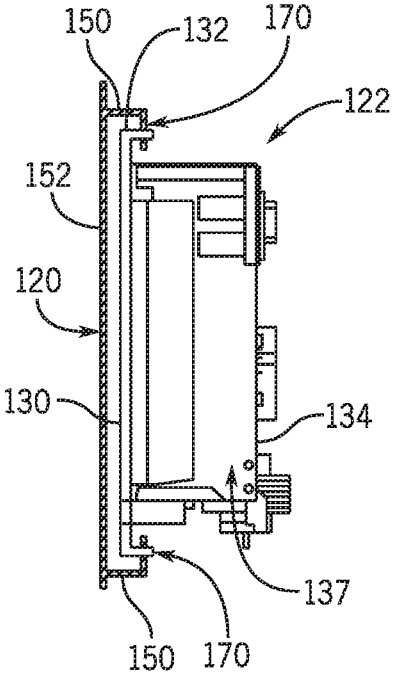
FIG. 12 is a schematic cross-sectional side view of a slidable electric control box interfaced with a mounting structure of the rooftop unit of FIG. 5, in accordance with an aspect of the present disclosure.

In FIG. 12, the mounting structure 120 includes the panel 152 and the guide rails 150 extending therefrom and including L-shaped cross-sections. Slots 170 (e.g., open-ended slots) may be defined within the guide rails 150 of the mounting structure 120, and the guide rails 132 of the slidable electric control box 122 may engage with (e.g., extend into) the slots 170. Thus, the guide rails 132 of the slidable electric control box 122 may slide along the guide rails 150 of the mounting structure 120 within the slots 170. Although two guide rails 150 of the mounting structure 120, two slots 170 corresponding to the two guide rails 150, and two guide rails 132 of the slidable electric control box 122 are included in the illustrated embodiment, another embodiment may include only one guide rail 150, one slot 170, and one guide rail 132.

Figure 13:
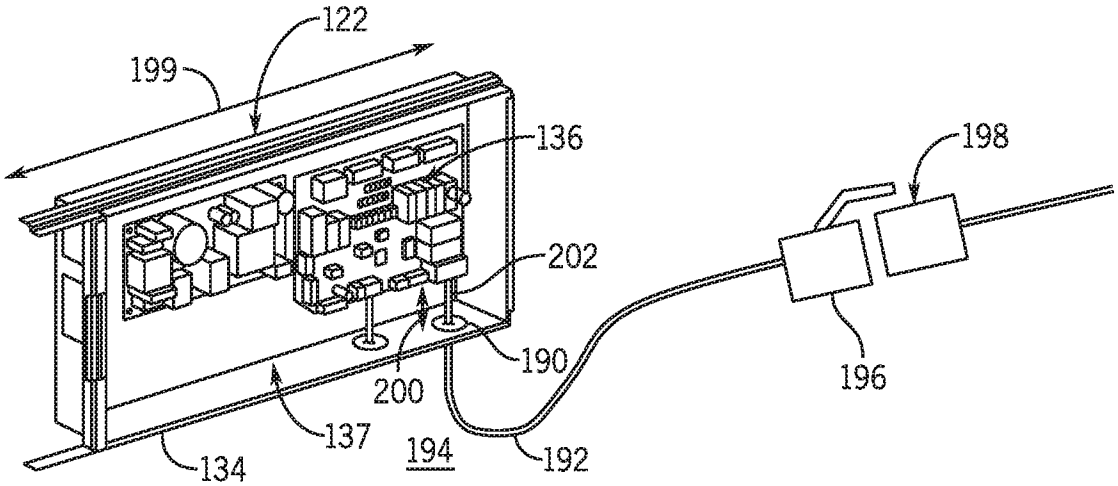
FIG. 13 is a perspective view of the slidable electric control box of FIG. 8 with a harness assembly for electric connection to a power source and/or data interface, in accordance with an aspect of the present disclosure.

FIG. 13 is a perspective view of an embodiment of the slidable electric control box 122 with a harness assembly for electric connection to a power source and/or data interface. In the illustrated embodiment, the cover plate is removed from the slidable electric control box 122 to illustrate the interior 137 having the electric components 136 disposed therein. As shown, a hole or opening 190 may extend through the housing 134, and a wire harness 192 may extend from one or more of the electric components 136, through the opening 190, and to an external environment 194 surrounding the slidable electric control box 122. The wire harness 192 may include wires configured to transmit power, data, or both.

The wire harness 192 may terminate at an electric connector 196, which is configured to be coupled to be coupled to another electric connector 198. Depending on the embodiment, the electric connector 196 may be a male connector and the electric connector 198 may be a female connector, or the electric connector 196 may be a female connector and the electric connector 198 may be a male connector. As shown, the wire harness 192 is sized to enable slack of the wire harness 192 while the slidable electric control box 122 is in an operational position. Thus, if the slidable electric control box 122 is moved along direction 199 to a maintenance position, a connection between the electric connector 196 attached to the wire harness 192 and the other electric connector 198 is not broken. In some embodiments, the slack of the wire harness 192 may be stowed within the interior 137 of the housing 122. Further, in some embodiments, the wire harness 192 may be rigidly coupled to the housing 122 at or adjacent to the opening 190, such that a length 200 of a portion 202 of the wire harness between the one or more electric components 136 and the opening 190 is constant even when the slidable electric control box 122 is slid between the operational position and the maintenance position.

Technical benefits of the disclosed embodiments include improved packaging, improved maintainability, and improved physical control of rooftop units and corresponding electric componentry.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. An air conditioning, ventilation, and/or air conditioning (HVAC) system, comprising:

a cabinet in which a plurality of HVAC components of the HVAC system is disposed;

a mount disposed in the cabinet and having a first guide disposed thereon, wherein the first guide comprises a first guide rail; and an electric control box having a second guide disposed thereon, wherein the second guide comprises a second guide rail, wherein the first guide rail and the second guide rail are configured to engage with each other to enable the electric control box to slide relative to the mount between an operational position within the cabinet and a maintenance position outside of the cabinet.

2. The HVAC system of claim 1, wherein the mount comprises a mounting bracket or a mounting panel from which the first guide rail of the first guide extends.

3. The HVAC system of claim 1, wherein the second guide rail comprises a U-shaped cross-section defining a space configured to receive a portion of the first guide rail.

4. The HVAC system of claim 1, wherein the second guide rail comprises an L-shaped cross-section and a portion of the L-shaped cross-section is configured to engage the first guide rail.

5. The HVAC system of claim 1, wherein the first guide rail includes a slot and the second guide rail is configured to extend through the slot, and wherein the second guide rail is configured to slide within the slot between the operational position and the maintenance position.

6. The HVAC system of claim 1, wherein the electric control box comprises a housing that encloses electrical components of the electric control box, and the housing comprises an opening through which a wire harness extends from the electrical components.

7. The HVAC system of claim 1, wherein the mount comprises an additional first guide rail and the electric control box comprises an additional second guide rail, and the additional first guide rail and the additional second guide rail are engaged with each other to enable the electric control box to slide relative to the mount between the operational position and the maintenance position.

8. The HVAC system of claim 1, comprising a rooftop unit (RTU) having the cabinet, the mount, and the electric control box.

9. The HVAC system of claim 1, wherein the cabinet comprises an electric control box cavity defined between a fan of the HVAC system and a compressor of the HVAC system, and the electric control box cavity is configured to receive the electric control box.

10. The HVAC system of claim 1, comprising a wheel disposed between the first guide rail and the second guide rail, wherein the first guide rail and the second guide rail are configured to engage via the wheel.

11. The HVAC system of claim 10, wherein the wheel is coupled to the first guide rail and configured to roll along the second guide rail.

12. The HVAC system of claim 10, wherein the wheel is coupled to the second guide rail and configured to roll along the first guide rail.

13. A heating, ventilation, and/or air conditioning (HVAC) system, comprising:

a cabinet in which a fan and a compressor of the HVAC system are disposed;

a mounting structure disposed in the cabinet and between the fan and the compressor, and having a first guide rail extending therefrom; and an electric control box disposed between the fan and the compressor, wherein the electric control box comprises a second guide rail engaged with the first guide rail and configured to slide along the first guide rail between an operational position in which the electric control box is disposed inside of the cabinet and a maintenance position in which the electric control box is disposed outside of the cabinet.

14. The HVAC system of claim 13, wherein the second guide rail comprises:

a U-shaped cross-section defining a space configured to receive a portion of the first guide rail; or an L-shaped cross-section configured to engage the portion of the first guide rail.

15. The HVAC system of claim 13, comprising a wheel disposed between the first guide rail and the second guide rail and configured to enable engagement between the first guide rail and the second guide rail, wherein:

the wheel is coupled to the first guide rail and configured to roll along the second guide rail; or the wheel is coupled to the second guide rail and configured to roll along the first guide rail.

16. The HVAC system of claim 13, wherein the first guide rail comprises a slot and the second guide rail is configured to extend through the slot, and wherein the second guide rail is configured to slide within the slot between the operational position and the maintenance position.

17. The HVAC system of claim 13, comprising a rooftop unit (RTU) having the cabinet, the mounting structure, and the electric control box.

18. A heating, ventilation, and/or air conditioning (HVAC) system, comprising:

a cabinet in which a fan and a compressor of the HVAC system are disposed;

a mount of the cabinet disposed between the fan and the compressor, and having a first guide rail extending therefrom; and an electric control box disposed between the fan and the compressor, wherein the electric control box comprises a second guide rail engaged with the first guide rail and configured to slide along the first guide rail between an operational position in which the electric control box is disposed inside of the cabinet and a maintenance position in which the electric control box is disposed outside of the cabinet, a housing that encloses electric components of the electric control box, a wire harness extending from the electric components, and an opening in the housing through which the wire harness extends.

19. The HVAC system of claim 18, wherein the second guide rail comprises:

a U-shaped cross-section defining a space configured to receive a portion of the first guide rail; or an L-shaped cross-section configured to engage the portion of the first guide rail.

20. The HVAC system of claim 18, comprising a wheel disposed between the first guide rail and the second guide rail and configured to enable engagement between the first guide rail and the second guide rail, wherein:

the wheel is coupled to the first guide rail and configured to roll along the second guide rail; or the wheel is coupled to the second guide rail and configured to roll along the first guide rail.

* * * * *